US011295880B2

(12) United States Patent
Hinata et al.

(10) Patent No.: US 11,295,880 B2
(45) Date of Patent: Apr. 5, 2022

(54) RFEB-BASED MAGNET AND METHOD FOR PRODUCING RFEB-BASED MAGNET

(71) Applicant: DAIDO STEEL CO., LTD., Nagoya (JP)

(72) Inventors: Jumpei Hinata, Nagoya (JP); Hayato Hashino, Nagoya (JP); Fumiya Kitanishi, Nagoya (JP); Kazuya Gomi, Nagoya (JP); Kazumasa Fujimura, Nagoya (JP)

(73) Assignee: DAIDO STEEL CO., LTD., Nagoya (JP)

( * ) Notice: Subject to any disclaimer, the term of this patent is extended or adjusted under 35 U.S.C. 154(b) by 344 days.

(21) Appl. No.: 16/017,691

(22) Filed: Jun. 25, 2018

(65) Prior Publication Data

US 2018/0374617 A1 Dec. 27, 2018

(30) Foreign Application Priority Data

Jun. 27, 2017 (JP) ..... JP2017-124954
May 11, 2018 (JP) ..... JP2018-092254

(51) Int. Cl.
*H01F 1/057* (2006.01)
*H01F 41/02* (2006.01)
(Continued)

(52) U.S. Cl.
CPC ..... *H01F 1/057* (2013.01); *B22F 7/02* (2013.01); *B22F 9/04* (2013.01); *C22C 28/00* (2013.01);
(Continued)

(58) Field of Classification Search
None
See application file for complete search history.

(56) References Cited

U.S. PATENT DOCUMENTS 8,002,906 B2 8/2011 Suzuki et al.
9,415,444 B2 8/2016 Kuniyoshi
(Continued)

FOREIGN PATENT DOCUMENTS

CN 101707107 A 5/2010
CN 102347126 A 2/2012
(Continued)

OTHER PUBLICATIONS

Machine translation of JP 2010-114200. (Year: 2010).*
(Continued)

*Primary Examiner* — Xiaowei Su
(74) *Attorney, Agent, or Firm* — McGinn I.P. Law Group, PLLC.

(57) ABSTRACT

The present invention relates to an RFeB-based magnet in which a treatment (grain boundary diffusion treatment) for diffusing atoms of the heavy rare earth element $R^H$ is performed in a base material including an $R^L$FeB-based sintered magnet obtained by subjecting crystal grains in a raw-material powder including a powder of an $R^L$FeB-based alloy containing the light rare earth element $R^L$, Fe and B to orientation in a magnetic field and then sintering the oriented raw-material powder, or an $R^L$FeB-based hot-deformed magnet obtained by subjecting the same raw-material powder to hot pressing and then to hot deforming to thereby orient the crystal grains in the raw-material powder, and a method for producing the RFeB-based magnet.

10 Claims, 4 Drawing Sheets

(51) Int. Cl.
*B22F 9/04* (2006.01)
*B22F 7/02* (2006.01)
*C22C 28/00* (2006.01)

(52) U.S. Cl.
CPC ..... *H01F 1/0576* (2013.01); *H01F 1/0577* (2013.01); *H01F 41/0266* (2013.01); *H01F 41/0293* (2013.01); *B22F 2201/013* (2013.01); *B22F 2301/45* (2013.01)

(56) References Cited

U.S. PATENT DOCUMENTS

| | | | | |
|---|---|---|---|---|
| 2007/0245851 | A1 | 10/2007 | Sagawa et al. | |
| 2009/0020193 | A1 | 1/2009 | Ohta et al. | |
| 2010/0003156 | A1 | 1/2010 | Suzuki et al. | |
| 2012/0112863 | A1 | 5/2012 | Kuniyoshi | |
| 2013/0343946 | A1 | 12/2013 | Sagawa et al. | |
| 2014/0062631 | A1* | 3/2014 | Sagawa ..... | H01F 1/0577 335/302 |
| 2016/0300649 | A1 | 10/2016 | Sagawa et al. | |

FOREIGN PATENT DOCUMENTS

| | | | |
|---|---|---|---|
| CN | 102453466 | A | 5/2012 |
| EP | 2 141 710 | A1 | 1/2010 |
| EP | 2 455 954 | A1 | 5/2012 |
| EP | 2 650 887 | A2 | 10/2013 |
| JP | 2006-019521 | A | 1/2006 |
| JP | 2010-114200 | A | 5/2010 |
| JP | 2011-159983 | A | 8/2011 |
| WO | WO 2014/148353 | A1 | 9/2014 |

OTHER PUBLICATIONS

Machine translation of CN 101707107A. (Year: 2010).*
Chinese Office Action, dated Nov. 27, 2019, in Chinese Application No. 201810681773.9 and English Translation thereof.
Development of Dy-omitted Nd—Fe—B-based hot worked magnet by using a rapidly quenched powder as a raw material, written by Hioki Keiko and Hattori Atsushi, Sokeizai, vol. 52, No. 8, pp. 19 to 24. General Incorporation Foundation Sokeizai Center, published on Aug. 2011.
L. G. Zhang and six others, "Thermodynamic assessment of Al—Cu-Dy system", Journal of Alloys and Compounds, Elsevier (Holland), vol. 480, pp. 403 to 408, Jul. 8, 2009.
Extended European Search Report dated Dec. 12, 2018 for European Patent Application No. 18179916.4-1212.

* cited by examiner

RFEB-BASED MAGNET AND METHOD FOR PRODUCING RFEB-BASED MAGNET

FIELD OF THE INVENTION

The present invention relates to an RFeB-based magnet and a method for producing an RFeB-based magnet, the RFeB-based magnet containing R (rare earth element), Fe (iron) and B (boron), in which the "rare earth element" is a generic term for 17 kinds of elements belonging to the group 3A in the periodic table. Of these 17 kinds of elements, the present invention is directed to a light rare earth element $R^L$ that is a generic term for 2 kinds of elements of Nd (neodymium) and Pr (praseodymium) and a heavy rare earth element $R^H$ that is a generic term for 3 kinds of elements of Tb (terbium), Dy (dysprosium) and Ho (holmium). More specifically, the present invention relates to an RFeB-based magnet in which a treatment (grain boundary diffusion treatment) for diffusing atoms of the heavy rare earth element $R^H$ is performed in a base material including an $R^L$FeB-based sintered magnet obtained by subjecting crystal grains in a raw-material powder including a powder of an $R^L$FeB-based alloy containing the light rare earth element $R^L$, Fe and B to orientation in a magnetic field and then sintering the oriented raw-material powder, or an $R^L$FeB-based hot-deformed magnet obtained by subjecting the same raw-material powder to hot pressing and then to hot deforming to thereby orient the crystal grains in the raw-material powder (see Non-Patent Document 1), and a method for producing the RFeB-based magnet.

BACKGROUND OF THE INVENTION

An RFeB-based magnet was found by Masato Sagawa et al. in 1982, and has an advantage that many magnetic properties including residual magnetic flux density are far higher than those of conventional permanent magnets. Accordingly, the RFeB-based magnet is used in various products such as drive motors of hybrid cars and electric cars, motors for electrically assisted bicycles, industrial motors, voice coil motors of hard disk drives and the like, speakers, headphones and permanent magnet type magnetic resonance diagnostic devices.

An early RFeB-based magnet had a defect of being relatively low in coercive force $H_{cJ}$ among various magnetic properties. However, it was thereafter found that the coercive force was improved by making the heavy rare earth element $R^H$ to be present inside the RFeB-based magnet. The coercive force is force that resists inversion of magnetization when a magnetic field in a direction opposite to the direction of the magnetization is applied to the magnet. It is considered that the heavy rare earth element $R^H$ hinders the inversion of magnetization, thereby having an effect of increasing the coercive force.

On the other hand, increasing the content of the heavy rare earth element $R^H$ in the RFeB-based magnet poses a problem in that the residual magnetic flux density $B_r$ is decreased, thereby also decreasing the maximum energy product $(BH)_{max}$. In addition, since the heavy rare earth element $R^H$ is expensive and rare, and is yielded only in localized regions, it is not desirable to increase the content of the heavy rare earth element $R^H$, also from the standpoint of stably supplying the RFeB-based magnets to the market at low cost.

Accordingly, a grain boundary diffusion treatment is conducted in order to increase the coercive force while keeping the content of the heavy rare earth element $R^H$ low (for example, see Patent Documents 1 and 2). In the grain boundary diffusion treatment, an $R^H$-containing substance that contains a heavy rare earth element $R^H$ is adhered to a surface of an $R^L$FeB-based sintered magnet or $R^L$FeB-based hot-deformed magnet which contains a light rare earth element $R^L$ as the rare earth element, and the magnet is heated, thereby causing atoms of the heavy rare earth element $R^H$ to penetrate to the inside of the magnet through grain boundaries. Thus, the heavy rare earth element $R^H$ is diffused only to the vicinity of surfaces of respective crystal grains. The $R^L$FeB-based sintered magnet or $R^L$FeB-based hot-deformed magnet which has not undergone the grain boundary diffusion treatment is hereinafter referred to as a "base material". A decrease in the coercive force occurs when the inversion of magnetization occurs in the vicinity of the surfaces of crystal grains and then spreads over the whole crystal grains. Consequently, by increasing the concentration of the heavy rare earth element $R^H$ in the vicinity of the surfaces of crystal grains, the inversion of magnetization can be inhibited and the coercive force can be enhanced. Meanwhile, since the heavy rare earth element $R^H$ localizes only in the vicinity of the surfaces (grain boundaries) of respective crystal grains, the overall concentration thereof can be suppressed. As a result, not only the residual magnetic flux density and the maximum energy product can be prevented from decreasing, but also the RFeB-based magnet can be stably supplied to the market at low cost.

Patent Document 1: JP-A-2011-159983

Patent Document 2: WO 2014/148353

Patent Document 3: JP-A-2006-019521

Non-Patent Document 1: "Development of Dy-omitted Nd—Fe—B-based hot worked magnet by using a rapidly quenched powder as a raw material", written by Hioki Keiko and Hattori Atsushi, Sokeizai, Vol. 52, No. 8, pages 19 to 24, General Incorporation Foundation Sokeizai Center, published on August, 2011

Non-Patent Document 2: L. G Zhang and six others, "Thermodynamic assessment of Al—Cu—Dy system", Journal of Alloys and Compounds, Elsevier (Holland), Vol. 480, pages 403 to 408, Jul. 8, 2009

SUMMARY OF THE INVENTION

The invention described in Patent Document 1 enumerates various alloys each including one or a plurality of kinds of heavy rare earth elements $R^H$ and one or a plurality of kinds of other metal elements M, as materials to be adhered to a surface of a base material. The document describes that the ratio of the mass of the other metal element M to the mass of the heavy rare earth element $R^H$ (defined as "$M/R^H$") is desirably from 1/100 to 5/1 (from 1 to 500%), and more desirably from 1/20 to 2/1 (from 5 to 200%). However, the amount of the heavy rare earth element $R^H$ that reaches the vicinity of surfaces of internal crystal grains through grain boundaries of a base material is completely different between the case where the $M/R^H$ is several percents and the case where it is several hundred percents. Furthermore, Patent Document 1 describes that the metal element in an $R^H$-containing substance is diffused into the grain boundaries, whereby a rare earth-rich phase present in the grain boundaries and having a higher rare earth element content than the crystal grains becomes easily melted, resulting in easy diffusion of the heavy rare earth element $R^H$ in the grain boundaries. However, the easiness of melting of the rare earth-rich phase in the grain boundaries varies depending on the $M/R^H$ ratio of the $R^H$-containing substance or the kind of metal element M. As described above, the amount of the heavy rare earth element $R^H$ that reaches the vicinity of the surfaces of internal crystal grains is determined according to not only a level of the $M/R^H$ ratio, but also complicated factors. Therefore, the requirements described in Patent Document 1 cannot always increase the coercive force more than the case where another $R^H$-containing substance is used.

On the other hand, Patent Document 2 describes that an $R^H$NiAl alloy containing $R^H$, Ni and Al at approximately 92:4:4 by mass ratio is used as a material of an $R^H$-containing substance to be adhered to a surface of a base material. The reason why Ni and Al are used is that since these elements have an action of lowering the melting point of a rare earth-rich phase, thereby melting the rare earth-rich phase in grain boundaries during a grain boundary diffusion treatment, heavy rare earth element $R^H$ can be easily diffused into the base material through the grain boundaries. However, the $R^H$NiAl alloy is not always a material optimum for the $R^H$-containing substance used in the grain boundary diffusion treatment, and a more suitable material has been required.

An object of the present invention is to surely provide an RFeB-based magnet having a high coercive force and a method for producing the RFeB-based magnet, which can efficiently perform a grain boundary diffusion treatment using an $R^H$-containing substance including a material more suitable than a conventional one.

In order to achieve the above-described object, a method for producing an RFeB-based magnet according to the present invention is a method for producing an RFeB-based magnet, the method including:

an adhesion substance preparation step of preparing an adhesion substance containing an $R^H$CuAl alloy which includes a contained heavy rare earth $R_C^H$ including one or a plurality of kinds of heavy rare earth elements $R^H$, Cu and Al, and has a composition represented by a point in an octagon with 8 coordinates, $(R_C^H{}_{at\ \%}, Cu_{at\ \%}, Al_{at\ \%})$=(50, 40, 10), (58, 30, 12), (58, 20, 22), (48, 20, 32), (33, 24, 43), (17, 50, 33), (17, 60, 23) and (33, 58, 9) as vertexes in a ternary composition diagram with $R_C^H$, Cu and Al as vertexes, or on a side of the octagon, an adhesion substance adhering step of adhering the adhesion substance to a surface of a base material including an $R^L$FeB-based sintered magnet body or $R^L$FeB-based hot-deformed magnet body which includes a contained light rare earth $R_C^L$ including one or two kinds of light rare earth elements $R^L$, Fe and B, and a heating step of heating the base material having the adhesion substance adhered thereto to a predetermined temperature at which atoms of the contained heavy rare earth $R_C^H$ in the adhesion substance diffuse into the base material through grain boundaries of the base material.

It is preferable that the above-described $R^H$CuAl alloy has a composition represented by a point in a hexagon with 6 coordinates, $(R_C^H{}_{at\ \%}, Cu_{at\ \%}, Al_{at\ \%})$=(50, 40, 10), (50, 32, 18), (33, 24, 43), (17, 50, 33), (17, 60, 23) and (33, 58, 9), as vertexes in the ternary composition diagram, or on a side of the hexagon.

In the method for producing an RFeB-based magnet according to the present invention, the $R^H$CuAl alloy is used in which Cu is used in place of Ni in the $R^H$NiAl alloy described in Patent Document 2. The contained heavy rare earth $R_C^H$ contained in the $R^H$CuAl alloy herein is one or a plurality of kinds of heavy rare earth elements $R^H$, that is, one, two or three kinds of elements of Tb, Dy and Ho. In addition, in the $R^H$NiAl alloy of Patent Document 2, the Ni content is about 4% by mass, that is, about 9 atomic %, whereas in this $R^H$CuAl alloy, the Cu content is at least 20 atomic %. The grain boundaries of the base material including an $R^L$FeB-based sintered magnet body or an $R^L$FeB-based hot-deformed magnet body become easily melted by using the adhesion substance ($R^H$CuAl alloy-containing substance) containing the $R^H$CuAl alloy having a difference from the $R^H$NiAl alloy of Patent Document 2. Thereby, atoms of the contained heavy rare earth $R_C^H$ contained in the $R^H$CuAl alloy can more efficiently reach the vicinity of the surfaces of the crystal grains, and an RFeB-based sintered magnet or RFeB-based hot-deformed magnet which has a high coercive force while suppressing decreases in residual magnetic flux density and maximum energy product can be obtained.

On the other hand, in the $R^H$CuAl alloy, a plurality of kinds of $R^H$CuAl phases ($R^H$CuAl, $R^HCu_4Al_8$, $R^H{}_2Cu_{17}Al_{17}$, $R^HCu_5Al_5$, $R^HCuAl_3$, $R^H{}_4Cu_4Al_{11}$, $R^HCu_3Al_3$ and the like) having different composition ratios of $R^H$, Cu and Al, Al-free $R^H$Cu phases and Cu-free $R^H$Al phases are generally present in a mixed state. Then, by the contents of $R^H$, Cu and Al in the whole $R^H$CuAl alloy, it is decided that which phase among those respective phases is contained therein. In order to increase the coercive force of the RFeB-based sintered magnet or the RFeB-based hot-deformed magnet, it is desirable to contain the $R^H$CuAl phase ($R^H$:Cu:Al is 1:1:1) in which the composition ratio of $R^H$ is highest among the above-mentioned respective $R^H$CuAl phases. Then, it is desirable to use the $R^H$CuAl alloy which is an alloy containing the $R^H$CuAl phase and has a composition represented by a point in a hexagon with 6 coordinates, $(R_C^H{}_{at\ \%}, Cu_{at\ \%}, Al_{at\ \%})$=(50, 40, 10), (50, 32, 18), (33, 24, 43), (17, 50, 33), (17, 60, 23) and (33, 58, 9), as vertexes in a ternary composition diagram, or on a side of the hexagon (see Non-Patent Document 2).

Furthermore, according to experiments made by the present inventors, it has been confirmed that a similar effect can be exerted, even when the $R^H$CuAl alloy having a composition represented by a point in a second hexagon that is a region in contact with the above-mentioned hexagon in a ternary composition diagram of $R^H$, Cu and Al, and has coordinates, $(R_C^H{}_{at\ \%}, Cu_{at\ \%}, Al_{at\ \%})$=(50, 40, 10), (58, 32, 12), (58, 20, 22), (48, 20, 32), (33, 24, 43) and (50, 32, 18) (in which, (50, 40, 10), (33, 24, 43) and (50, 32, 18) are in common with the vertexes of the above-mentioned hexagon), as vertexes, or on a side of the second hexagon. Accordingly, by performing the grain boundary diffusion treatment using the adhesion substance containing the $R^H$CuAl alloy having the composition represented by the point in the above-mentioned octagon that is a region formed by combining the hexagon with the second hexagon, or on the side of the octagon, the RFeB-based sintered magnet or RFeB-based hot-deformed magnet which has a high coercive force while suppressing decreases in residual magnetic flux density and maximum energy product can be obtained.

In addition, Cu is diffused into the grain boundaries of the RFeB-based sintered magnet or the RFeB-based hot-deformed magnet by the method for producing an RFeB-based magnet according to the preset invention, thereby also exerting an effect of more improving corrosion resistance of the RFeB-based magnet than the case where the $R^H$NiAl alloy is used.

The RFeB-based magnet having the following configuration is obtained by the method for producing an RFeB-based magnet according to the preset invention. The RFeB-based magnet according to the present invention is an RFeB-based sintered magnet or RFeB-based hot-deformed magnet which includes a contained light rare earth $R_C^L$ including one or two kinds of light rare earth elements $R^L$, a contained heavy rare earth $R_C^H$ including one or a plurality of kinds of heavy rare earth elements $R^H$, Fe and B, and has two surfaces opposed to each other approximately in parallel, in which the content of the contained heavy rare earth $R_C^H$ is higher in a grain boundary than in a crystal grain, and the content of the contained heavy rare earth $R_C^H$ is from 0.40 to 1.25% by mass, the content of Cu is from 3.9 to 14.0% by mass, and the content of Al is from 0.09 to 1.00% by mass, in the grain boundary in a plane equidistant from the two surfaces in the RFeB-based magnet.

The contents of $R_C^H$, Cu and Al in the $R^H$CuAl alloy in the method for producing an RFeB-based magnet according to the preset invention are indicated by atomic percentage. However, the contents of $R_C^H$, Cu and Al in the grain boundary of the RFeB-based magnet according to the present invention are indicated by mass percentage based on actual measurement values. The grain boundary contains not only $R_C^H$, Cu and Al derived from the $R^H$CuAl alloy, but also $R_C^L$, Fe, B and the like present in the grain boundary of the base material.

Within a range where the content of the contained heavy rare earth $R_C^H$ in the grain boundary is relatively small, the more the content thereof increases, the higher the coercive force becomes. However, according to actual measurement values described later, in the case where the above-mentioned adhesion substance is adhered to two surfaces of the base material, which are opposed to each other approximately in parallel and then the grain boundary diffusion treatment is performed thereto, when the content of the contained heavy rare earth $R_C^H$ exceeds 1.25% by mass in the plane equidistant from the two surfaces in the RFeB-based magnet, an increase in the content does not cause an increase in coercive force. Accordingly, even when the content of the contained heavy rare earth $R_C^H$ in the grain boundary exceeds 1.25% by mass, the contained heavy rare earth $R_C^H$ is wasted. Therefore, in the RFeB-based magnet according to the present invention, the upper limit value of the content of the contained heavy rare earth $R_C^H$ in the grain boundary is set to 1.25% by mass. On the other hand, when the content of the contained heavy rare earth $R_C^H$ in the grain boundary is less than 0.40% by mass, the sufficient coercive force cannot be obtained. Therefore, in the RFeB-based magnet according to the present invention, the lower limit value of the content of the contained heavy rare earth $R_C^H$ in the grain boundary is set to 0.40% by mass. The ranges of the contents of Cu and Al in the grain boundary are determined by actually measuring the contents of Cu and Al in the grain boundary, when the grain boundary diffusion treatment is performed so that the content of the contained heavy rare earth $R_C^H$ in the grain boundary becomes 0.40 to 1.25% by mass using the $R^H$CuAl alloy having the composition within the range specified in the method for producing an RFeB-based magnet according to the present invention.

When it is necessary to further increase the coercive force and it is permitted to slightly lower the value of the residual magnetic flux density, the heavy rare earth element $R^H$ is sometimes contained in the base material. When the base material used in the method for producing an RFeB-based magnet according to the preset invention contains the heavy rare earth element $R^H$, in the RFeB-based magnet produced thereby, not only the content of the contained heavy rare earth $R_C^H$ in the grain boundary, but also the content of the contained heavy rare earth $R_C^H$ in the crystal grain has a nonzero value. As described above, in the case where the contained heavy rare earth $R_C^H$ is contained, the above-mentioned adhesion substance is adhered to the two surfaces of the base material, which are opposed to each other approximately in parallel, and then the grain boundary diffusion treatment is performed thereto, the value obtained by subtracting the content of the contained heavy rare earth $R_C^H$ in the crystal grains from the content of the contained heavy rare earth $R_C^H$ in the grain boundary, in the plane equidistant from the two surfaces in the RFeB-based magnet, is from 0.40 to 1.25% by mass. Meanwhile, the amounts of Cu and Al contained in the base material is slight. Therefore, the contents of Cu and Al in the grain boundary in the above-mentioned plane in the RFeB-based magnet produced by allowing the contained heavy rare earth $R_C^H$ to be contained in the base material by the method according to the present invention are from 3.9 to 14.0% by mass for Cu and from 0.09 to 1.00% by mass for Al, as with the above.

According to the present invention, a grain boundary diffusion treatment can be efficiently performed using an $R^H$-containing substance including a material more suitable than a conventional one, thereby surely obtaining an RFeB-based magnet having a high coercive force while suppressing decreases in residual magnetic flux density and maximum energy product, and a method for producing the RFeB-based magnet.

DETAILED DESCRIPTION OF THE INVENTION

Embodiments of an RFeB-based magnet and a method for producing the same according to the present invention will be described with reference to FIGS. 1 to 7.

(1) Embodiments of Method for Producing RFeB-Based Magnet According to Present Invention (1-1) Base Material A base material used in the embodiments of the method for producing an RFeB-based magnet includes one or two kinds of light rare earth elements $R^L$, that is, an $R^L$FeB-based sintered magnet body or $R^L$FeB-based hot-deformed magnet body which contains Nd and/or Pr, Fe and B. Of these, the $R^L$FeB-based sintered magnet body may be prepared by a press method of press-forming an $R^L$FeB-based alloy powder as a raw material while orienting the powder by a magnetic field and then sintering the powder, or a PLP (press-less process) method of orienting an $R^L$FeB-based alloy powder in a mold by a magnetic field without press-forming the powder and then sintering the powder as it is, as described in Patent Document 3. The PLP method is preferred in that the coercive force can be more increased, and in that the $R^L$FeB-based sintered magnet body having a complicated shape can be prepared without performing machining. The $R^L$FeB-based hot-deformed magnet body can be prepared by the method described in Non-Patent Document 1.

(1-2) $R^H$CuAl Alloy

Figure 1:
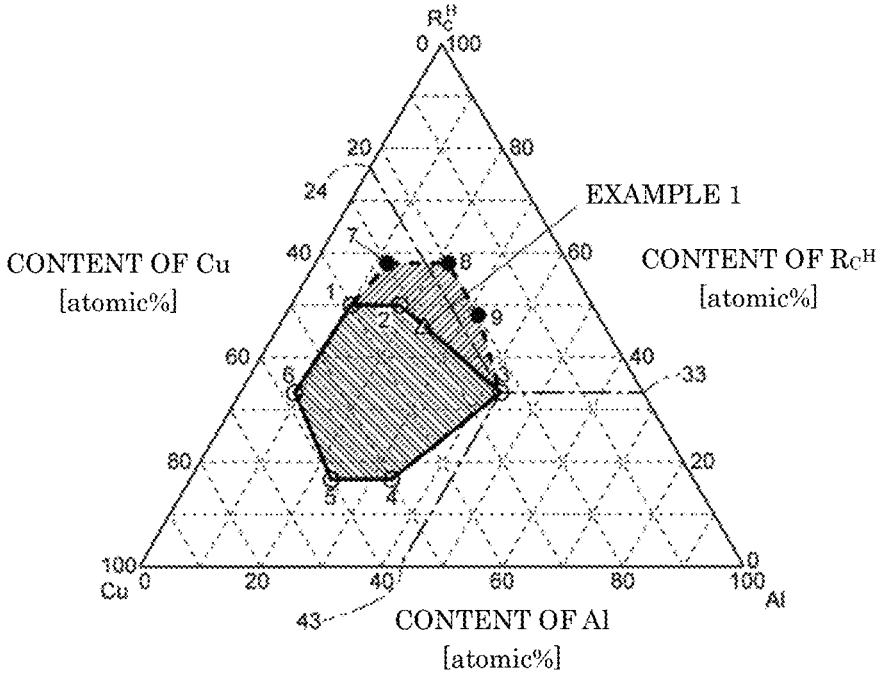
FIG. 1 is a ternary composition diagram showing a composition of an $R^H$CuAl alloy used in a method for producing an RFeB-based magnet according to the present invention.

FIG. 1 shows a composition of an $R^H$CuAl alloy used in the embodiments of the method for producing an RFeB-based magnet. This figure is a diagram generally called a ternary composition diagram, and one point in the diagram shows the contents of 3 kinds of elements, $R_C^H$, Cu and Al, in which $R_C^H$ may be any one of Tb, Dy and Ho. In this diagram, it is assumed that $R_C^H$ is one kind of element (that is, any one kind of Tb, Dy and Ho). However, in the actual $R^H$CuAl alloy, atoms of two or three kinds of elements of Tb, Dy and Ho may be mixed.

For the content of $R_C^H$, the vertex of the triangle described as "$R_C^H$" in FIG. 1 is 100 atomic %, and the opposite side to the vertex is 0 atomic %. For example, in FIG. 1, the numerical value "33" at a point at which a straight line drawn in parallel to the opposite side from a point 3 intersects a side described as "CONTENT OF $R_C^H$" indicates that the content of $R_C^H$ at the point 3 is 33 atomic %. Similarly, at the point 3, the Cu content is 24 atomic %, and the Al content is 43 atomic %.

The contents of the respective atoms of $R_C^H$, Cu and Al at points 1 to 9 in FIG. 1 are as shown in Table 1. In Table 1, in addition to the atomic contents, the mass contents are also described together, for the case where $R_C^H$ is Dy and the case where $R_C^H$ is Tb.

TABLE 1

| Point in | Composition of $R^H$CuAl alloy [atomic %] | | | Composition of DyCuAl alloy [mass %] | | | Composition of TbCuAl alloy [mass %] | | |
|---|---|---|---|---|---|---|---|---|---|
| FIG. 1 | $R_C^H$ | Cu | Al | Dy | Cu | Al | Tb | Cu | Al |
| 1 | 50 | 40 | 10 | 74.3 | 23.2 | 2.5 | 73.9 | 23.6 | 2.5 |
| 2 | 50 | 32 | 18 | 76.3 | 19.1 | 4.6 | 75.9 | 19.4 | 4.6 |
| 3 | 33 | 24 | 43 | 66.8 | 18.6 | 14.6 | 66.1 | 19.2 | 14.6 |
| 4 | 17 | 50 | 33 | 40.4 | 46.5 | 13.0 | 39.9 | 46.9 | 13.2 |
| 5 | 17 | 60 | 23 | 38.4 | 53.0 | 8.6 | 37.9 | 53.4 | 8.7 |
| 6 | 33 | 58 | 9 | 57.7 | 39.7 | 2.6 | 57.2 | 40.2 | 2.6 |
| 7 | 58 | 30 | 12 | 80.9 | 16.4 | 2.8 | 80.5 | 16.7 | 2.8 |
| 8 | 58 | 20 | 22 | 83.5 | 11.3 | 5.3 | 83.2 | 11.5 | 5.4 |
| 9 | 48 | 20 | 32 | 78.5 | 12.8 | 8.7 | 78.1 | 13.0 | 8.8 |

In the embodiments of the method for producing an RFeB-based magnet, the $R^H$CuAl alloy having the contents of the respective atoms of $R_C^H$, Cu and Al indicated by a point in the first hexagon (shown by hatched lines drawn from the upper left to the lower right in FIG. 1) with the points 1 to 6 as the vertexes, which is indicated by thick solid lines in FIG. 1, or on a side of the hexagon can be used in a grain boundary diffusion treatment described later. In the $R^H$CuAl alloy having such contents, there is present a ternary $R^H$CuAl phase ($R^H$:Cu:Al is 1:1:1) having a larger $R_C^H$ composition ratio than that of the other phases, and therefore, the coercive force of the RFeB-based sintered magnet or the RFeB-based hot-deformed magnet can be increased. The range in which the $R^H$CuAl phase described herein is present is based on the ternary composition diagram at 573K (300° C.) shown in Non-Patent Document 2.

In addition, in the embodiments of the method for producing an RFeB-based magnet, the $R^H$CuAl alloy having the contents of the respective atoms of $R_C^H$, Cu and Al indicated by points in a second hexagon (shown by hatched lines drawn from the upper right to the lower left in FIG. 1) with points 1, 7, 8, 9, 3 and 2 as the vertexes, which is indicated by thick broken lines in FIG. 1, or on a side of the hexagon can also be used in a grain boundary diffusion treatment described later. It has been proved by experiments described later that the $R^H$CuAl alloy having these contents exhibits action equivalent to that of $R^H$CuAl alloy having the contents indicated by the first hexagon.

Accordingly, in the embodiments of the method for producing an RFeB-based magnet, the $R^H$CuAl alloy having the contents of the respective atoms of $R_C^H$, Cu and Al indicated by a point in the octagon formed by combining the first hexagon and the second hexagon, with the points 1, 7, 8, 9, 3, 4, 5 and 6 as the vertexes, or on a side of the octagon is used.

(1-3) Adhesion Substance ($R^H$CuAl Alloy-Containing Substance), Adhesion Substance Preparation Step An adhesion substance used in the embodiments of the method for producing an RFeB-based magnet contains the above-mentioned $R^H$CuAl alloy. The adhesion substance may be composed of the $R^H$CuAl alloy such as a powder or foil of the $R^H$CuAl alloy, but may be a mixture of the powder of the $R^H$CuAl alloy and another material as described below. The materials to be mixed with the powder of the $R^H$CuAl alloy typically include organic solvents. Use of the organic solvent makes it possible to easily adhere the adhesion substance to a surface of the base material. Of the organic solvents, particularly, a silicone-based organic solvent including silicone grease, silicone oil or a mixture thereof can be suitably used. Use of such a silicone-based organic solvent more increases adhesiveness of the adhesion substance to the base material, and the atoms of $R_C^H$ become easily transferred to the grain boundaries of the base material during the grain boundary diffusion treatment. Therefore, the coercive force of the RFeB-based magnet can be more increased. The viscosity of the adhesion substance can be adjusted by mixing the silicone grease and the silicone oil at an appropriate ratio.

(1-4) Grain Boundary Diffusion Treatment

Using the base material and adhesion substance prepared as described above, the grain boundary diffusion treatment is performed as follows. First, an adhesion substance 12 is adhered to a surface of a base material 11 (FIG. 2A, the adhesion substance ($R^H$CuAl alloy-containing substance) adhering step). The adhesion substance 12 may be adhered to the entire surface of the base material 11, or may be adhered to a part of the surface. For example, the adhesion substance 12 obtained by mixing the silicone-based organic solvent can be adhered to two plate surfaces of the plate-shaped base material 11 by coating. In this case, side faces of the base material 11 are not coated with the adhesion substance 12.

Figure 2A:
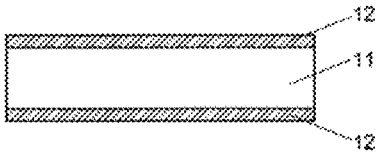
FIGS. 2A and 2B are schematic views showing steps of one embodiment of a method for producing an RFeB-based magnet.
Figure 2B:
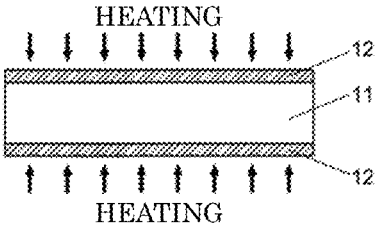

Then, the base material 11 coated with the adhesion substance 12 is heated to a predetermined temperature (FIG. 2B, a heating step). The predetermined temperature as used herein is a temperature at which atoms of a contained heavy rare earth $R_C^H$ in the adhesion substance 12 diffuse into the base material 11 through grain boundaries of the base material 11, and typically from 700 to 1,000° C. By this heating step, the atoms of the contained heavy rare earth $R_C^H$ in the adhesion substance 12 diffuse into the base material 11 through the grain boundaries of the base material 11, thereby increasing the concentration of $R_C^H$ mainly in the vicinity of surfaces of crystal grains in the base material 11. On the other hand, the atoms of the contained heavy rare earth $R_C^H$ are difficult to enter the inside of the grains. Therefore, the RFeB-based magnet (RFeB-based sintered magnet or RFeB-based hot-deformed magnet) in which the content of the contained heavy rare earth $R_C^H$ is higher in the grain boundary than in the crystal grain is obtained by this heating step. Thereafter, an aging treatment (a treatment in which the base material is heated at a relatively low temperature of about 500° C.), a grinding treatment for removing the residue of the adhesion substance 12 remaining on the surfaces of the base material 11 and a magnet shaping treatment are performed as needed, thereby obtaining the RFeB-based magnet as a final product.

The content of the contained heavy rare earth $R_C^H$ in the grain boundary of the RFeB-based magnet obtained is from 0.40 to 1.25% by mass, although it depends on the content of the contained heavy rare earth $R_C^H$ in the $R^H$CuAl alloy and the kind of the contained heavy rare earth $R_C^H$ of the base material 11. In addition, the content of Cu in the grain boundary of the RFeB-based magnet obtained is from 3.9 to 14.0% by mass, and the content of Al in the grain boundary thereof is from 0.09 to 1.00% by mass.

(2) Examples of Method for Producing RFeB-Based Magnet According to Present Invention and Embodiments of RFeB-Based Magnet According to Present Invention Then, examples of producing the RFeB-based magnet by the embodiments of the method for producing an RFeB-based magnet and performing composition analysis in the grain boundary of the RFeB-based magnet obtained are explained, and embodiments of the RFeB-based magnet according to the present invention are explained based on the experimental results of the examples.

In Example 1, a plate-shaped $R^L$FeB-based sintered magnet body containing no $R^H$ and small amounts of Cu and Al (Cu: 0.1% by mass, Al: 0.2% by mass) and having a thickness of 5 mm was used as a base material. An $R^H$CuAl alloy in which $R^H$ was Tb, having a Tb content of 46.00 atomic % (74.53% by mass), a Cu content of 30.00 atomic % (19.01% by mass) and an Al content of 24.00 atomic % (6.46% by mass), was prepared by a strip cast method. The contents of respective elements of this $R^H$CuAl alloy correspond to a point marked by triangles in FIG. 1. An adhesion substance was prepared by mixing silicone grease with an $R^H$CuAl alloy powder obtained by pulverizing this $R^H$CuAl alloy by a hydrogen pulverization process and then removing hydrogen.

Figure 3:
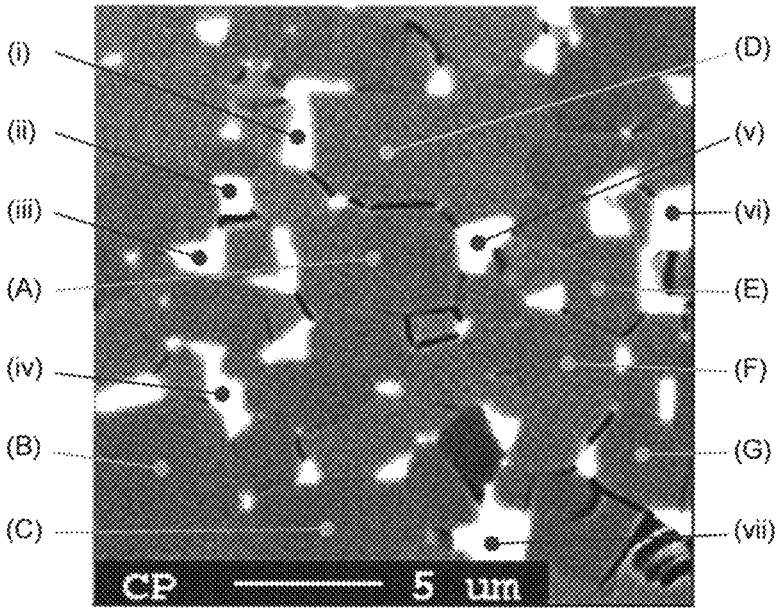
FIG. 3 is a diagram showing an example of specifying places at which composition analysis are performed based on a sample image obtained by an EPMA device.

The amount of the adhesion substance to be adhered to the base material was adjusted so that the mass of Tb in the adhesion substance to the mass of the base material was within a range of 0.2 to 1.4%, and a plurality of experiments different in the amount of the adhesion substance were performed. The adhesion substance was adhered to two entire plate surfaces of the plate-shaped base material, and not adhered to four side faces. The composition analysis in the grain boundary of the RFeB-based magnet obtained was performed using an EPMA device (manufactured by JEOL Ltd., JXA-8500F). In this analysis, for positions in the grain boundaries, one place was randomly designated from each one of grain-boundary triple points different from one another, that is, 7 places in total were randomly designated at positions of 2.5 mm in depth from positions corresponding to the surface of the base material (that is, positions equidistant from the both surfaces of the base material), and an average value of 5 places excluding 2 places showing the maximum and minimum Tb contents was determined. FIG. 3 shows an example in which positions (i) to (vii) in the grain-boundary triple points of 7 places were designated based on a backscattered electron image of a sample, which was obtained by the EPMA device.

Figure 4:
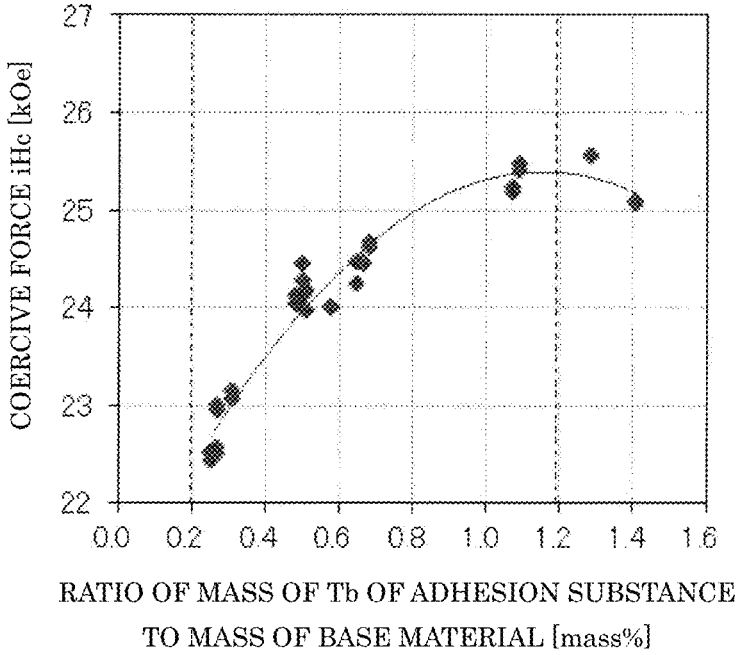
FIG. 4 is a graph showing the measurement results of coercive force iHc for an RFeB-based magnet prepared by one example of a method for producing an RFeB-based magnet.
Figure 5:
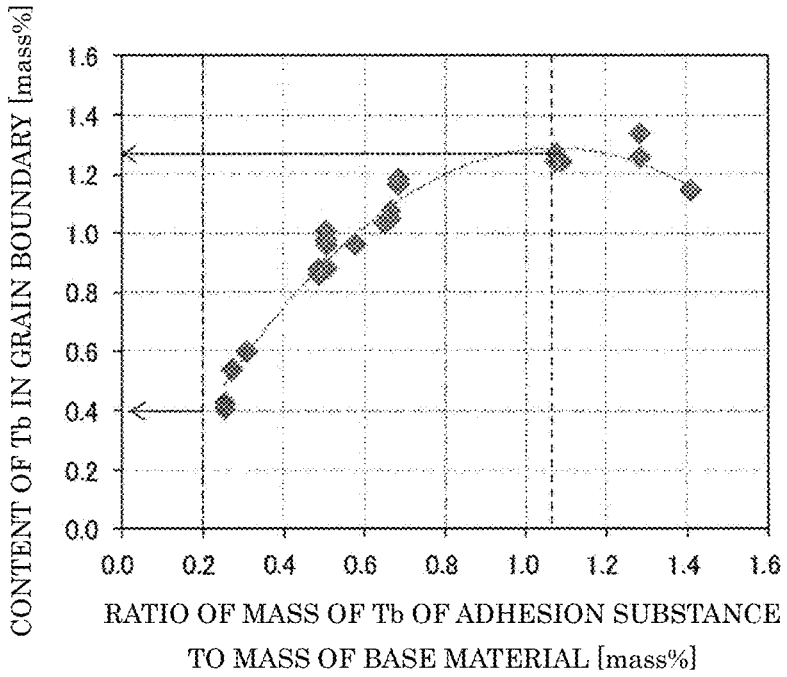
FIG. 5 is a graph showing the measurement results of the content of Tb in a grain boundary for an RFeB-based magnet prepared by one example of a method for producing an RFeB-based magnet.

For the RFeB-based magnet obtained, the results of measurement of the coercive force iHc are shown in FIG. 4, and the results of measurement of the Tb content in the grain boundary are shown in FIG. 5. From FIG. 4, when the mass of Tb in the adhesion substance to the mass of the base material is within a range of 0.2 to 1.2% by mass, the coercive force increases with an increase in the mass of Tb in the adhesion substance. Meanwhile, when the mass of Tb in the adhesion substance to the mass of the base material exceeds 1.2% by mass, such an increase in the coercive force is not observed. When the mass of Tb in the adhesion substance to the mass of the base material is within a range of 0.2 to 1.2% by mass, in which the effect of increasing the coercive force has been observed as described above, the content of Tb in the grain boundary is from 0.40 to 1.25% by mass, as shown in FIG. 5.

Furthermore, for TbCuAl alloys having 6 kinds of compositions corresponding to the points 1 to 6 in FIG. 1, as shown in Table 1, RFeB-based magnets were prepared under the same conditions as in Example 1 except for the TbCuAl alloy used, in each of the case where the mass of Tb in the adhesion substance to the mass of the base material was 0.2% by mass and the case where it was 1.2% by mass, and the contents of Tb, Cu and Al in the grain boundary were measured. In addition, for TbCuAl alloys having 3 kinds of compositions corresponding to the points 7 to 9 in FIG. 1, as shown in Table 1, and TbCuAl alloys having 6 kinds of compositions corresponding to points A to F in FIG. 6, as shown in Table 2, RFeB-based magnets were prepared under the same conditions as in Example 1 except for the TbCuAl alloy used, in the case where the mass of Tb in the adhesion substance to the mass of the base material was 1.0% by mass, and the contents of Tb, Cu and Al in the grain boundary were measured (the above is defined as Example 2). Here, all of the points A to F in FIG. 6 are present in the octagon described above.

TABLE 2

Figure 6:
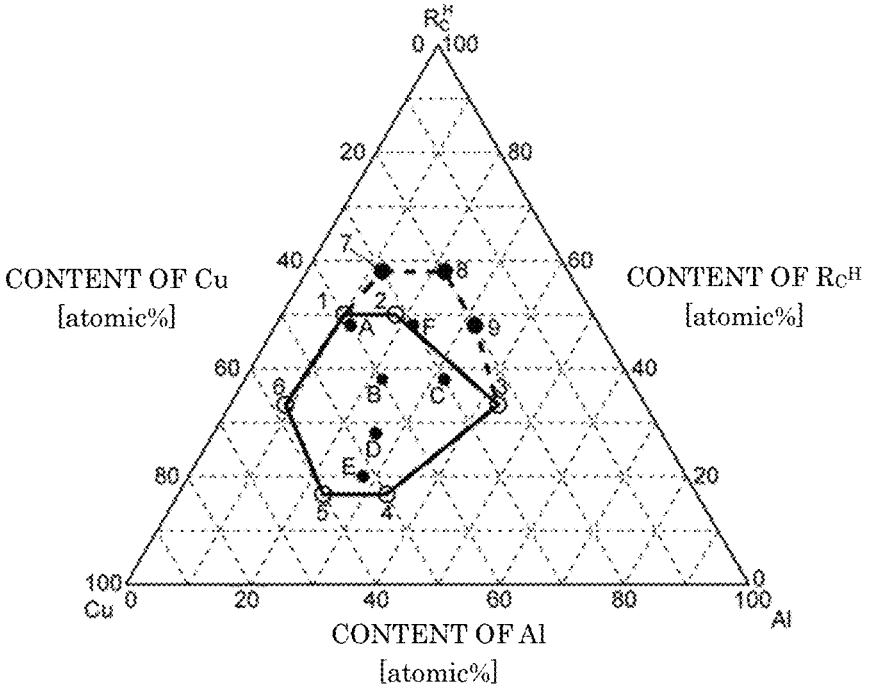
FIG. 6 is a ternary composition diagram showing a composition of another $R^H$CuAl alloy used in a method for producing an RFeB-based magnet according to the preset invention.

| Point in | Composition of $R^H$CuAl alloy [atomic %] | | | Composition of TbCuAl alloy [mass %] | | |
|---|---|---|---|---|---|---|
| FIG. 6 | $R_C^H$ | Cu | Al | Tb | Cu | Al |
| A | 48 | 40 | 12 | 72.7 | 24.2 | 3.1 |
| B | 38 | 40 | 22 | 65.8 | 27.7 | 6.5 |
| C | 38 | 30 | 32 | 68.6 | 21.6 | 9.8 |
| D | 28 | 46 | 26 | 55.1 | 36.2 | 8.7 |
| E | 20 | 52 | 28 | 43.9 | 45.7 | 10.4 |
| F | 48 | 30 | 22 | 75.3 | 18.8 | 5.9 |

The results of Example 2 are shown in Table 3.

TABLE 3

| Sample No. | Point in FIG. 1 or 6 | Composition of TbCuAl alloy [atomic %] | | | Mass ratio of each element and whole alloy in adhesion substance to base material [mass %] | | | TbCuAl alloy | Composition in grain boundary [mass %] | | |
|---|---|---|---|---|---|---|---|---|---|---|---|
| | | Tb | Cu | Al | Tb | Cu | Al | | Tb | Cu | Al |
| 1 | 1 | 50 | 40 | 10 | 0.20 | 0.06 | 0.01 | 0.27 | 0.41 | 4.00 | 0.09 |
| 2 | 2 | 50 | 32 | 18 | 0.20 | 0.05 | 0.01 | 0.26 | 0.41 | 3.92 | 0.11 |
| 3 | 3 | 33 | 24 | 43 | 0.20 | 0.06 | 0.04 | 0.30 | 0.41 | 3.96 | 0.18 |
| 4 | 4 | 17 | 50 | 33 | 0.20 | 0.23 | 0.06 | 0.49 | 0.41 | 5.05 | 0.23 |
| 5 | 5 | 17 | 60 | 23 | 0.20 | 0.28 | 0.04 | 0.52 | 0.41 | 5.34 | 0.18 |
| 6 | 6 | 33 | 58 | 9 | 0.20 | 0.14 | 0.01 | 0.35 | 0.41 | 4.47 | 0.10 |
| 7 | 1 | 50 | 40 | 10 | 1.20 | 0.38 | 0.04 | 1.62 | 1.23 | 5.97 | 0.17 |
| 8 | 2 | 50 | 32 | 18 | 1.20 | 0.30 | 0.07 | 1.57 | 1.23 | 5.50 | 0.25 |
| 9 | 3 | 33 | 24 | 43 | 1.20 | 0.33 | 0.26 | 1.80 | 1.23 | 5.71 | 0.71 |
| 10 | 4 | 17 | 50 | 33 | 1.20 | 1.38 | 0.39 | 2.97 | 1.23 | 12.29 | 1.00 |
| 11 | 5 | 17 | 60 | 23 | 1.20 | 1.66 | 0.27 | 3.13 | 1.23 | 14.02 | 0.72 |
| 12 | 6 | 33 | 58 | 9 | 1.20 | 0.82 | 0.05 | 2.08 | 1.23 | 8.79 | 0.21 |
| 13 | 7 | 58 | 30 | 12 | 1.00 | 0.21 | 0.04 | 1.24 | 1.14 | 4.90 | 0.07 |
| 14 | 8 | 58 | 20 | 22 | 1.00 | 0.14 | 0.06 | 1.20 | 1.17 | 4.47 | 0.24 |
| 15 | A | 48 | 40 | 12 | 1.00 | 0.33 | 0.04 | 1.38 | 1.13 | 5.70 | 0.18 |
| 16 | 9 | 48 | 20 | 32 | 1.00 | 0.17 | 0.11 | 1.28 | 1.22 | 4.65 | 0.35 |
| 17 | B | 38 | 40 | 22 | 1.00 | 0.42 | 0.10 | 1.52 | 1.24 | 6.25 | 0.32 |
| 18 | C | 38 | 30 | 32 | 1.00 | 0.32 | 0.14 | 1.46 | 1.16 | 5.59 | 0.42 |
| 19 | D | 28 | 46 | 26 | 1.00 | 0.66 | 0.16 | 1.82 | 1.15 | 7.77 | 0.45 |
| 20 | E | 20 | 52 | 28 | 1.00 | 1.03 | 0.24 | 2.27 | 1.14 | 10.09 | 0.66 |
| 21 | F | 48 | 30 | 22 | 1.00 | 0.25 | 0.06 | 1.33 | 1.23 | 5.17 | 0.27 |

From Table 3, the content of Tb in the grain boundary of each sample was approximately equivalent to the value in Example 1. In addition, the content of Cu in the grain boundary was from 3.9 to 14.0% by mass, and the content of Al in the grain boundary was from 0.09 to 1.00% by mass.

Then, using adhesion substances containing alloys having the compositions shown in Table 4, RFeB-based sintered magnets of Comparative Examples 1 to 6 were prepared in the same manner as in Examples 1 and 2. For the alloys in the adhesion substances, alloys containing Ni or Co in place of Cu were used in Comparative Examples 1 to 3, and binary alloys (containing no Al) composed of Tb and any one of Cu, Ni and Co were used in Comparative Examples 4 to 6. The amount of the adhesion substance of each example was adjusted so that the amount of Tb in the adhesion substance adhered to the base material became the same in all examples. For the RFeB-based sintered magnets of Examples 1 and 2 and Comparative Examples 1 to 6 thus obtained, samples in each of which the base material was polished by 0.15 mm from two plate surfaces thereof were prepared, and the amount of Tb in these samples was measured. The reason why such polishing is performed herein is that surface polishing is performed as finishing also in an actual product of the RFeB-based sintered magnet, and that useless Tb is removed in order to confirm the efficiency of the grain boundary diffusion treatment, because useless Tb remaining without diffusing in the base material is present in the vicinity of the surfaces of the base material. The amount of Tb in each sample is shown in Table 4 as the ratio to the amount of Tb in the adhesion substance adhered to the base material. In the term "Example 2-X" in Table 4, X is any one of 7 to 9 and A to F, and is a symbol that represents a composition of the TbCuAl alloy and is shown in Tables 1 and 2 and FIGS. 1 and 6.

TABLE 4

| | Composition of alloy used [mass %] | | | | | Ratio of amount of Tb in sample to amount of Tb in adhesion substance used |
|---|---|---|---|---|---|---|
| | Tb | Cu | Ni | Co | Al | [mass %] |
| Example 1 | 74.53 | 19.01 | — | — | 6.46 | 77.1 |
| Example 2-7 | 80.6 | 16.6 | — | — | 2.9 | 73.3 |
| Example 2-8 | 83.1 | 11.4 | — | — | 5.4 | 74.8 |
| Example 2-A | 72.7 | 24.3 | — | — | 3.1 | 72.4 |
| Example 2-9 | 78.1 | 13.0 | — | — | 8.8 | 78.2 |
| Example 2-B | 65.8 | 27.7 | — | — | 6.6 | 81.0 |
| Example 2-C | 68.6 | 21.7 | — | — | 9.8 | 74.2 |
| Example 2-D | 55.1 | 36.5 | — | — | 8.6 | 73.7 |
| Example 2-E | 44.0 | 45.4 | — | — | 10.6 | 73.1 |
| Example 2-F | 75.3 | 18.8 | — | — | 5.9 | 79.1 |
| Comparative Example 1 | 92.0 | — | 4.3 | — | 3.7 | 66.0 |
| Comparative Example 2 | 74.0 | — | 19.7 | — | 6.3 | 72.2 |
| Comparative Example 3 | 74.0 | — | — | 24.3 | 5.7 | 65.4 |
| Comparative Example 4 | 85.6 | 14.4 | — | — | — | 54.1 |
| Comparative Example 5 | 85.0 | — | 15.0 | — | — | 67.3 |
| Comparative Example 6 | 85.0 | — | — | 17.8 | — | 68.5 |

From the results of this experiment, it was confirmed that the amount of Tb in the samples was larger in Examples 1 and 2 than in Comparative Examples 1 to 6, which made it possible to diffuse Tb more efficiently into the base materials.

Figure 7:
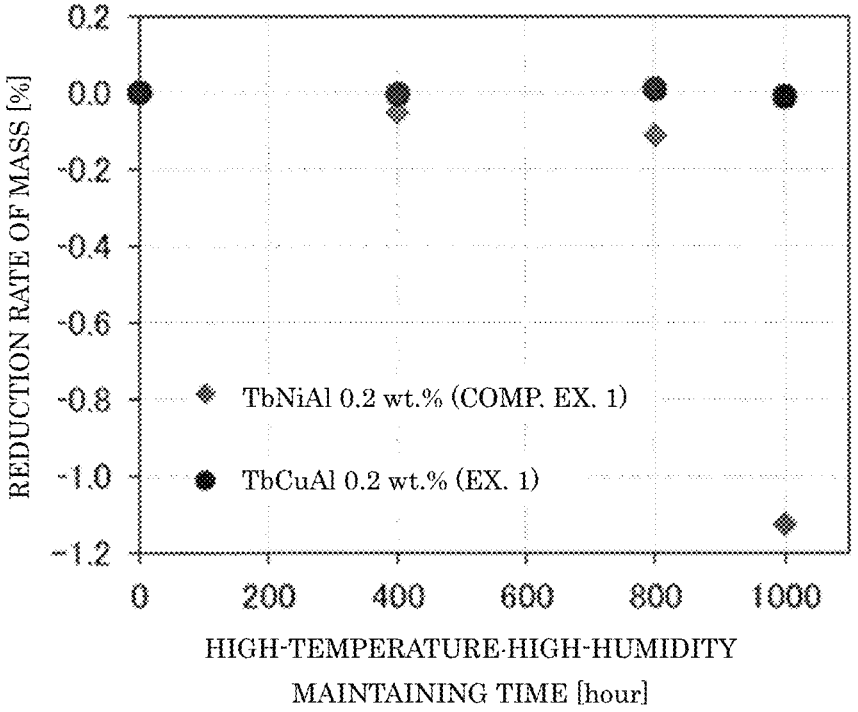
FIG. 7 is a graph showing the results of a corrosion resistance test performed for RFeB-based magnets of Examples and Comparative Examples.

Then, for the samples of Example 1 and Comparative Example 1, a corrosion resistance test was performed. The results thereof are shown in FIG. 7. In this test, after the mass of the sample was measured, the sample was maintained under high-temperature and high-humidity conditions of a temperature of 120° C., a humidity of 100% and a pressure of 2 atm (saturated water vapor pressure) for 400 to 1,000 hours, and thereafter the mass of the sample was measured, thereby determining the reduction rate of the mass of the sample. The smaller absolute value of the reduction rate of the mass means the higher corrosion resistance. From FIG. 7, in Comparative Example 1, the absolute value of the reduction rate of the mass became larger, as the time for maintaining the sample under the high-temperature and high-humidity conditions became longer, whereas in Example 1, the reduction rate of the mass was approximately 0, even when the sample was maintained under the high-temperature and high-humidity conditions for 1,000 hours. By this corrosion test, it was confirmed that the sample of Example 1 was higher in corrosion resistance than the sample of Comparative Example 1. This is considered because in Example 1, the potential in the grain boundary was raised by the presence of Cu in the grain boundary to suppress elution of a rare earth-rich (Nd-rich) grain boundary phase and suppress falling off of RFeB (NdFeB) grains.

Next, as embodiments of the method for producing an RFeB-based magnet according to the present invention, the results of performing the grain boundary diffusion treatment using $R^H$CuAl alloys to $R^H$-containing base materials are shown. In these embodiments, there were used 3 kinds of RFeB-based sintered magnet base materials containing Tb as $R^H$ in amounts of 0.20%, 4.40% and 10.0% by mass, respectively, and Cu and Al in the same amounts as in Example 1 (Cu: 0.1% by mass, Al: 0.2% by mass), and adhesion substances which were TbCuAl alloys having the compositions indicated by the points 8, B and F, respectively, in FIG. 6 as the $R^H$CuAl alloys. The amount of the adhesion substance was adjusted so that the content of Tb in the adhesion substance to the base material became 0.20% by mass or 1.00% by mass. For 18 kinds of samples combining these 3 kinds of base materials, 3 kinds of adhesion substances and 2 kinds of Tb contents in the adhesion substance, the contents of Tb, Cu and Al in the grain boundary were measured under the same conditions as in Examples 1 and 2. In addition, the content of Tb in the crystal grain positioned at the same depth from the base material surface as that at which the contents of Tb and the like in the grain boundary were measured was also measured by the EPMA device. For positions for measuring the content of Tb in the crystal grain, one place was designated from each one of the crystal grains different from one another, that is, 7 places in total were designated, and an average value in 5 places excluding 2 places showing the maximum and minimum Tb contents was determined. FIG. 3 shows an example in which positions (A) to (G) in the crystal grains of 7 places were designated based on a backscattered electron image of a sample, which was obtained by the EPMA device.

TABLE 5

| Sample No. | Amount of heavy rare earth element $R^H$ contained in base material [mass %] | Composition of TbCuAl alloy [atomic %] Point in FIG. 6 | Tb | Cu | Al | Mass ratio of each element in adhesion substance to base material [%] $R^H$ | Cu | Al | $R_C^H$ amount in crystal grain [mass %] | Composition in grain boundary [mass %] $R_C^H$ | Cu | Al | ($R_C^H$ amount in grain boundary) − ($R_C^H$ amount in crystal grain) [mass %] |
|---|---|---|---|---|---|---|---|---|---|---|---|---|---|
| 1 | 0.20 | 8 | 58 | 20 | 22 | 0.20 | 0.03 | 0.01 | 0.20 | 0.68 | 3.98 | 0.11 | 0.48 |
| 2 | 0.20 | B | 38 | 40 | 22 | 0.20 | 0.08 | 0.02 | 0.21 | 0.69 | 4.39 | 0.12 | 0.48 |
| 3 | 0.20 | F | 48 | 30 | 22 | 0.20 | 0.05 | 0.02 | 0.21 | 0.67 | 4.21 | 0.11 | 0.46 |
| 4 | 0.20 | 8 | 58 | 20 | 22 | 1.00 | 0.14 | 0.06 | 0.24 | 1.43 | 4.63 | 0.18 | 1.19 |
| 5 | 0.20 | B | 38 | 40 | 22 | 1.00 | 0.42 | 0.10 | 0.22 | 1.45 | 6.61 | 0.17 | 1.23 |
| 6 | 0.20 | F | 48 | 30 | 22 | 1.00 | 0.25 | 0.08 | 0.23 | 1.43 | 5.27 | 0.17 | 1.20 |
| 7 | 4.40 | 8 | 58 | 20 | 22 | 0.20 | 0.03 | 0.01 | 4.43 | 4.88 | 4.01 | 0.11 | 0.45 |
| 8 | 4.40 | B | 38 | 40 | 22 | 0.20 | 0.08 | 0.02 | 4.47 | 4.93 | 4.38 | 0.12 | 0.46 |
| 9 | 4.40 | F | 48 | 30 | 22 | 0.20 | 0.05 | 0.02 | 4.46 | 4.90 | 4.01 | 0.10 | 0.44 |
| 10 | 4.40 | 8 | 58 | 20 | 22 | 1.00 | 0.14 | 0.06 | 4.50 | 5.50 | 4.59 | 0.17 | 1.00 |
| 11 | 4.40 | B | 38 | 40 | 22 | 1.00 | 0.42 | 0.10 | 4.57 | 5.64 | 6.56 | 0.17 | 1.07 |
| 12 | 4.40 | F | 48 | 30 | 22 | 1.00 | 0.25 | 0.08 | 4.53 | 5.56 | 5.35 | 0.18 | 1.03 |
| 13 | 10.00 | 8 | 58 | 20 | 22 | 0.20 | 0.03 | 0.01 | 10.08 | 10.52 | 3.94 | 0.10 | 0.44 |
| 14 | 10.00 | B | 38 | 40 | 22 | 0.20 | 0.08 | 0.02 | 10.08 | 10.54 | 4.27 | 0.11 | 0.46 |
| 15 | 10.00 | F | 48 | 30 | 22 | 0.20 | 0.05 | 0.02 | 10.10 | 10.52 | 3.93 | 0.11 | 0.42 |
| 16 | 10.00 | 8 | 58 | 20 | 22 | 1.00 | 0.14 | 0.06 | 10.19 | 11.06 | 4.71 | 0.16 | 0.87 |
| 17 | 10.00 | B | 38 | 40 | 22 | 1.00 | 0.42 | 0.10 | 10.22 | 10.95 | 6.34 | 0.18 | 0.73 |
| 18 | 10.00 | F | 48 | 30 | 22 | 1.00 | 0.25 | 0.08 | 10.21 | 10.98 | 5.20 | 0.17 | 0.77 |

From Table 5, it is known that the difference between the content of Tb in the grain boundary and the content of Tb in the crystal grain falls within a range of 0.40 to 1.25% by mass, regardless of the content of Tb in the base material, although the content of Tb in the grain boundary covers a wide range of 0.67 to 11.06% by mass, depending on the content of Tb in the base material. This range is the amount of Tb ($R^H$) supplied to the grain boundaries appropriately in the effect of improving the coercive force due to the grain boundary diffusion treatment.

The present application is based on Japanese patent application No. 2017-124954 filed on Jun. 27, 2017, and Japanese patent application No. 2018-092254 filed on May 11, 2018, and the contents of which are incorporated herein by reference.

DESCRIPTION OF REFERENCE NUMERALS AND SIGNS

11 Base material

12 Adhesion substance ($R^H$CuAl alloy-containing substance)

What is claimed is:

1. A method for producing an RFeB-based magnet, the method comprising:

preparing an adhesion substance containing an $R^H$CuAl alloy which comprises a contained heavy rare earth $R_C^H$ including one or a plurality of kinds of heavy rare earth elements $R^H$, Cu, and Al, and has a composition represented by a point in an octagon with 8 coordinates, $(R_C{}^H{}_{a\%}, Cu_{at\%}, Al_{at\%})$=(50, 40, 10), (58, 30, 12), (58, 20, 22), (48, 20, 32), (33, 24, 43), (17, 50, 33), (17, 60, 23), and (33, 58, 9), as vertexes in a ternary composition diagram with $R_C{}^H$, Cu, and Al as vertexes, or on a side of the octagon;

adhering the adhesion substance to a surface of a base material comprising an $R^L$FeB-based sintered magnet which comprises a contained light rare earth $R_C{}^L$including one or two kinds of light rare earth elements $R^L$, Fe, and B; and heating the base material having the adhesion substance adhered thereto to a predetermined temperature at which atoms of the contained heavy rare earth $R_C{}^H$ in the adhesion substance diffuse into the base material through grain boundaries of the base material, wherein the RFeB-base magnet has a coercive three of 22.5 kOe or more, and the predetermined temperature is in a range from 820° C. to 1,000° C.

2. The method for producing an RFeB-based magnet according to claim 1, wherein the $R^H$CuAl alloy has a composition represented by a point in a hexagon with 6 coordinates, $(R_C{}^H{}_{at\%}, Cu_{at\%}, Al_{at\%})$=(50, 40, 10), (50, 32, 18), (33, 24, 43), (17, 50, 33), (17, 60, 23), and (33, 58, 9), as vertexes in the ternary composition diagram, or on a side of the hexagon.

3. The method for producing an RFeB-based magnet according to claim 1, wherein, after the heating, a content by mass of the Cu in the grain boundary of the RFeB-based magnet is in a range from 3.9% to 14.0%.

4. The method for producing an RFeB-based magnet according to claim 3, wherein, after the heating, a content by mass of the Al in the grain boundary of the RFeB-based magnet is in a range from 0.09% to 1.00%.

5. The method for producing an RFeB-based magnet according to claim 1, wherein, after the heating, a content by mass of the Al in the grain boundary of the RFeB-based magnet is in a range from 0.09% to 1.00%.

6. The method for producing an RFeB-based magnet according to claim 1, wherein the one or the plurality of kinds of heavy rare earth elements RH comprises Tb, and wherein a mass ratio of the Tb to the base. material is in a range from 0.2% to 1.2%.

7. The method for producing an RFeB-based magnet according to claim 1, wherein the one or the plurality of kinds of heavy rare earth elements RH is consisted of Tb, and wherein a mass ratio of the Tb to the base material is in a range from 0.2% to 1,2%.

8. The method for producing an RFeB-based magnet according to claim 1, wherein, after the heating, a content by mass of the contained heavy rare earth $R_C{}^H$ in a grain boundary of the RFeB-based magnet is in a range from 0.40% to $1.25_C{}^H$ %.

9. The method for producing an RFeB-based magnet according to claim 1, further comprising an aging treatment in which the base material is heated at a lower temperature than the predetermined temperature.

10. The method for producing an RFeB-based magnet according to claim 9, wherein the temperature of the aging treatment is about 500° C.

* * * * *